US007286791B2

(12) United States Patent
Ishii et al.

(10) Patent No.: US 7,286,791 B2
(45) Date of Patent: Oct. 23, 2007

(54) DEVELOPING APPARATUS

(75) Inventors: Yasuyuki Ishii, Mishima (JP); Atsushi Numagami, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 11/275,144

(22) Filed: Dec. 15, 2005

(65) Prior Publication Data

US 2006/0133851 A1 Jun. 22, 2006

(30) Foreign Application Priority Data

Dec. 16, 2004 (JP) ..... 2004-364985

(51) Int. Cl.
*G03G 15/08* (2006.01)

(52) U.S. Cl. ..... 399/265; 399/234

(58) Field of Classification Search ..... 399/234, 399/265

See application file for complete search history.

(56) References Cited

U.S. PATENT DOCUMENTS 5,473,416 A * 12/1995 Endou et al. ..... 399/265
5,604,573 A 2/1997 Endo et al. ..... 399/55
6,144,820 A 11/2000 Ishii et al. ..... 399/90
6,229,979 B1 5/2001 Ishii et al. ..... 399/281
6,289,197 B1 9/2001 Matsumoto et al. ..... 399/281
6,308,038 B1 10/2001 Kakeshita et al. ..... 399/286
6,522,842 B1 2/2003 Uehara et al. ..... 399/55
6,594,462 B2 7/2003 Ishii et al. ..... 399/281
2005/0008401 A1 1/2005 Kawamura et al. ..... 399/265

FOREIGN PATENT DOCUMENTS

JP 8-22185 1/1996

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

A developing device includes a developer carrying member for carrying a developer to develop an electrostatic image formed on an image bearing member with a developer, wherein an oscillating electric field is formed between the developer carrying member and the image bearing member; a jumping developer blocking member, provided between the image bearing member and the developer carrying member, for blocking a part of a region in which the developer jumps from the developer carrying member to the image bearing member, the jumping developer blocking member including an insulative portion and an electrically floating electroconductive portion opposed to the developer carrying member.

12 Claims, 18 Drawing Sheets

DEVELOPING APPARATUS

FIELD OF THE INVENTION AND RELATED ART

The present invention relates to a developing device for developing an electrostatic image which has been formed on an image bearing member through an electrophotographic method, electrostatic recording method or the like, with a developer into a visualized image. The developing device may be provided in a cartridge, electrophotographic copying machine, electrophotographic printer or another image forming apparatus.

An image forming apparatus, such as a laser beam printer or a copying machine, using an electrophotographic method has been proposed.

Referring first to FIG. 17, there is shown an electrophotographic printer which is an example of such an image forming apparatus. The fundamental structure and operation of the electrophotographic printer will be described.

In the electrophotographic printer 100, an electrophotographic photosensitive member as an image bearing member in the form of a drum (photosensitive drum) 1 is electrically charged to a uniform potential by a primary charger 2. Then, the photosensitive drum 1 is exposed to light in accordance with image information supplied form an outside by an exposure device 3, by which an electrostatic latent image is formed on the photosensitive drum 1. The electrostatic latent image on the photosensitive drum 1 is developed into a visualized image namely a toner image with a developer (toner) carried on a developing roller 11 (developer carrying member) in the developing device 10. The toner T is a non-magnetic one component toner having a negative charging property which is the same as the polarity of the triboelectric charge polarity of the voltage applied by the primary charger 2.

The toner image is transferred onto a transfer material Q supplied from the sheet feeding apparatus 7 by a transfer charger 4. The transfer material Q is separated from the photosensitive drum 1 and fed into the fixing device 6 and is subjected to a fixing operation, wherein the toner image is fixed into a permanent image. The toner T remaining on the photosensitive drum 1 without being transferred, is removed by a cleaning device 5, and the photosensitive drum 1 is prepared for the next image forming process.

The developing device 10 comprises a developing container 10A, the developing roller 11 therein, first and second stirring members 14 (14*a*, 14*b*) machined into a proper form. The first stirring member 14*a* and the second stirring member 14*b* are rotated in the direction indicated by an arrow in FIG. 17 to feed the toner T from the developing container 10A to the developing roller 11.

Between the first stirring member 14*a* and the developing roller 11, there is provided a developer supply and removing roller 12 for supplying the developer to the developing roller 11 and for removing the developer from the developing roller 11, and between the developer supply and removing roller 12 and the first stirring member 14*a*, there is provided a developing container partition plate 15. The partition plate 15 has a height so as to supply a constant amount of the toner to the developer supply and removing roller 12 adjacent the developing roller 11.

In a non-magnetic one component developing system used in this example of the image forming apparatus, the toner supply cannot be made by a magnetic force, and therefore, a developer supply and removing roller 12 of urethane sponge is contacted to the developing roller 11. The developer supply and removing roller 12 is rotated in the counter directional peripheral movement relative to the developing roller 11 at the nip formed with the developing roller 11, so that toner T is supplied onto the developing roller 11, and simultaneously, the toner remaining on the developing roller 11 without being consumed for the development is removed.

To the developing roller 11, a regulating blade 13 (developer amount regulating member) is contacted to regulate the amount of the toner on the developing roller 11 to form a thin toner layer thereon, so that amount of the toner fed to the developing zone where the developing roller is opposed to the drum 1 is regulated. The amount of the toner fed into the developing zone 20 is determined by the contact pressure of the regulating blade 13 to the developing roller 11, the contact length and the like.

The regulating blade 13 is manufactured by bonding or welding an insulative member on a thin metal plate such as a phosphor bronze, stainless steel or the like having a thickness of several hundreds μm, and is uniformly contacted to the developing roller 11 by the elastic property of the thin metal plate. The contact condition of the regulating blade 13 is determined depending on the material, the thickness, the entering amount, and the setting angle of the thin metal plate.

The developing roller 11 is opposed to the surface of the photosensitive drum in the developing zone 20 with a predetermined clearance (SD gap). The developing roller 11 is supplied with a developing bias voltage which is an AC (AC) voltage biased with a DC (DC) voltage, from a developing bias voltage source 41, so that oscillating (AC) electric field is formed between the developing roller 11 and the photosensitive drum 1. The electric field formed between the developing roller 11 and the photosensitive drum 1 by the developing bias is an alternating electric field which alternates in the dark portion potential portion on the photosensitive member and also in the light portion potential portion.

With such a structure, the toner is fed into the developing zone 20 on the surface of the developing roller with a desired charge amount and with the desired layer thickness, and is reciprocated by the oscillating electric field between the surface of the developing roller 11 and the surface of the photosensitive drum 1 to visualize the electrostatic latent image formed on the surface of the photosensitive drum.

However, as described hereinbefore, in the developing device using an oscillating electric field, an image defect which is caused by a "heap" or ununiform gathering of the developer.

Referring to FIG. 18, "heap" will be described. FIG. 18 is a cross-sectional view of the photosensitive drum 1 and the developing roller 11.

The "heap" is the gathering of the toner at a rear end portion as indicated by H in this Figure. When such gathering of the toner occurs, the density of the image at this portion is high, which deteriorates the image quality.

As shown in FIG. 18, when an AC voltage is applied between the photosensitive drum 1 and the developing roller 11, an electric field of barrel shape is formed between them. The toner deposited on the surface of the developing roller reciprocates between the photosensitive drum 1 and the developing roller 11 along the lines of electric force provided by the electric field, and therefore, the toner moves toward outsides away from the closest point S between the photosensitive drum 1 and the developing roller 11. When the AC voltage is applied, the toner T1 in the developing zone has a velocity component tending to move outwardly.

The description will be made as to the actual developing operation wherein the photosensitive drum 1 bearing an electrostatic latent image and the developing roller 11 are rotated in the directions indicated by the arrows.

In FIG. 18, the latent image portion is indicated by the potential −100V which is to receive the toner, and the portion of −500V is the reference potential portion of the photosensitive drum 1 which is not to receive the toner. When the latent image portion reaches the developing zone 20, the toner T is transferred from the developing roller 11 onto the latent image portion. Here, the jumping toner T1 involves the outward velocity component as described hereinbefore, and therefore, the jumping toner T1 moves toward upstream of the latent image portion.

At the boundary between the −100V portion and the −500V portion, there is an electric field directing from the −500V portion to the −100V portion. By this, the toner T1 having moved to the upstream of the latent image portion stops at the boundary. Therefore, the amount of the toner is larger at the rear end than at the upstream and central portion of the latent image portion. Thus, a "heap" is formed.

A method for reducing the heap has been proposed wherein a plate-like member (electrode member) is inserted between the photosensitive drum and the developing roller in the non-contact development using a two component developer (Japanese Laid-open Patent Application Hei 8-22185, for example) However, the structure disclosed in Japanese Laid-open Patent Application Hei 8-22185, does not work properly, and therefore, not enough to prevent the heaping in the developing device using the non-magnetic one component developer.

Accordingly, it is a principal object of the present invention to provide a developing device in which "heaping" can be suppressed with a simple and easy method thus accomplishing image formation with stabilized image density to the end of the service life of the developing device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
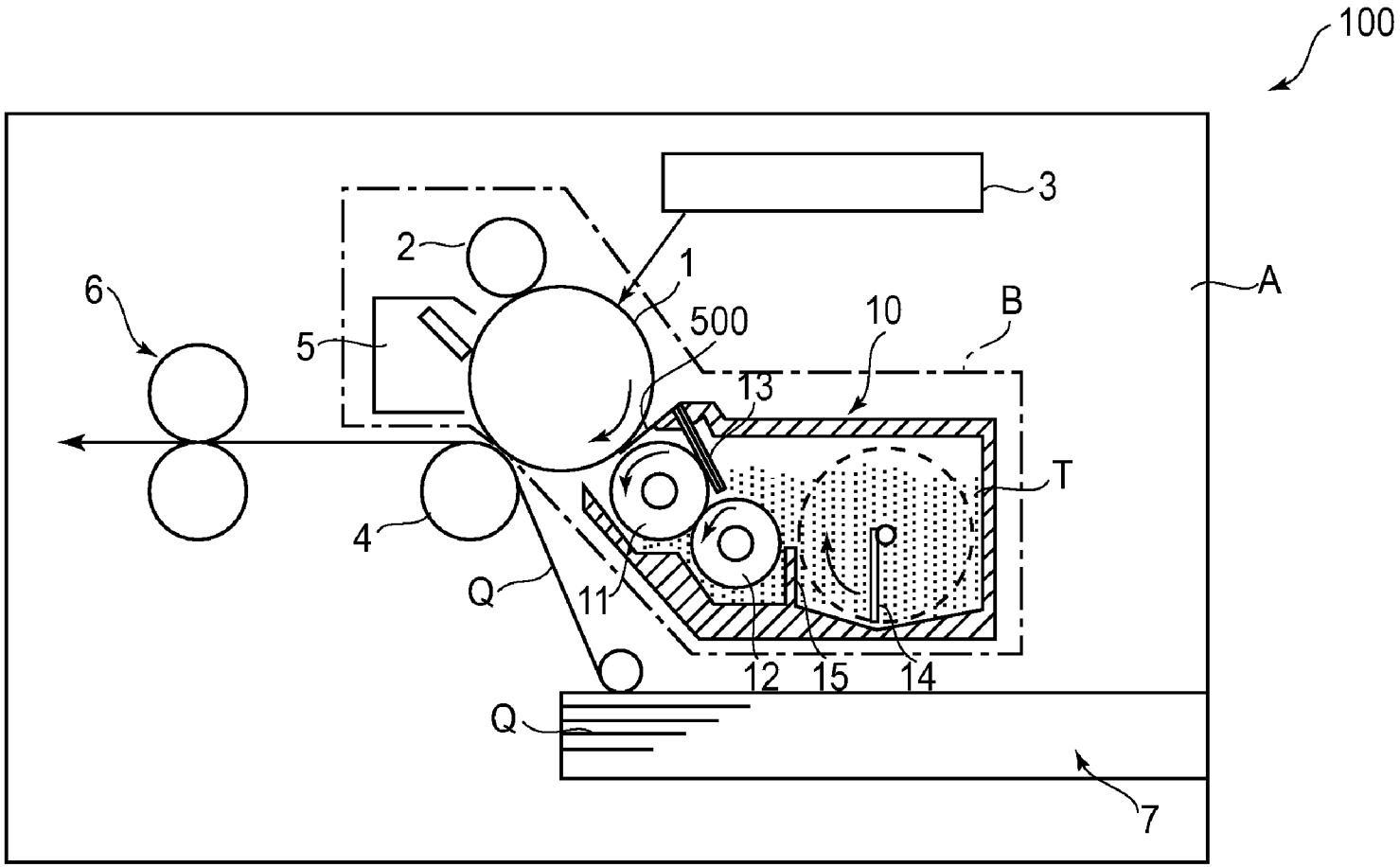
FIG. 1 is a schematic illustration of an image forming apparatus according to an embodiment of the present invention.

FIG. 1 is a sectional view of an image forming apparatus 100 and a developing device 10 according to an embodiment of the present invention.

Figure 17:
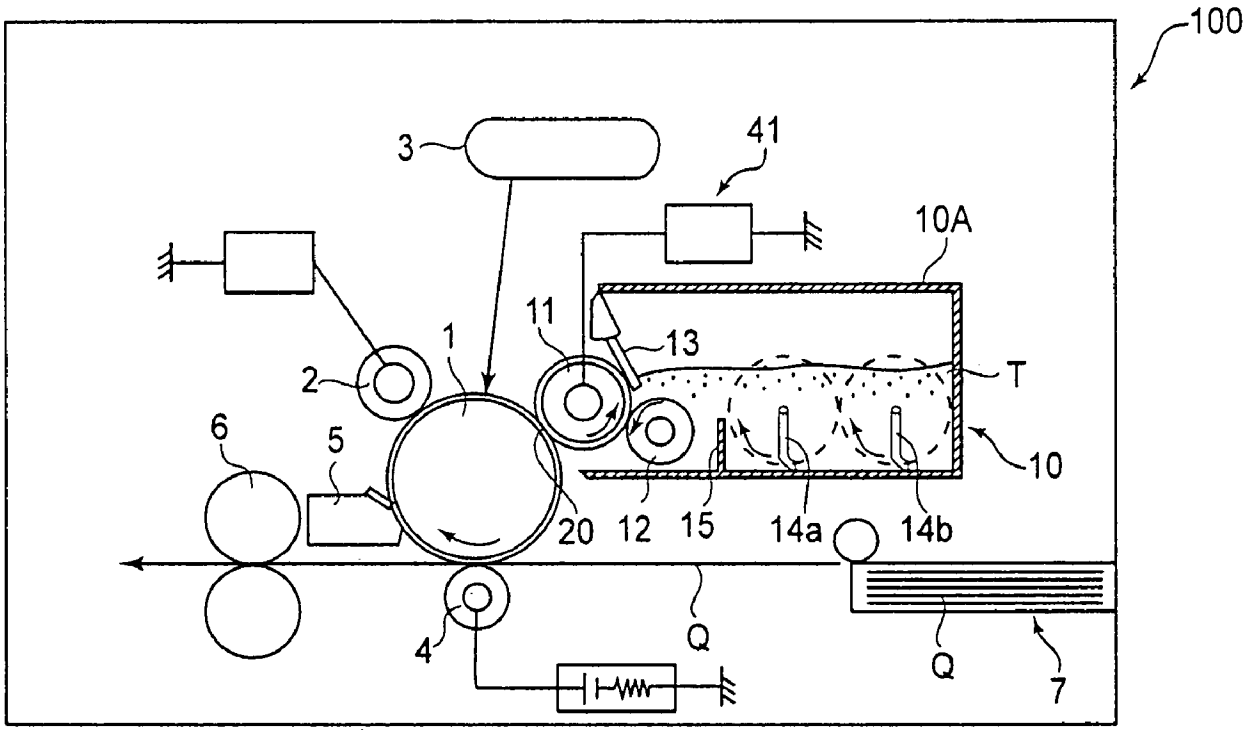
FIG. 17 PRIOR ART
FIG. 17 is a schematic illustration of a conventional electrophotographic apparatus.
Figure 18:
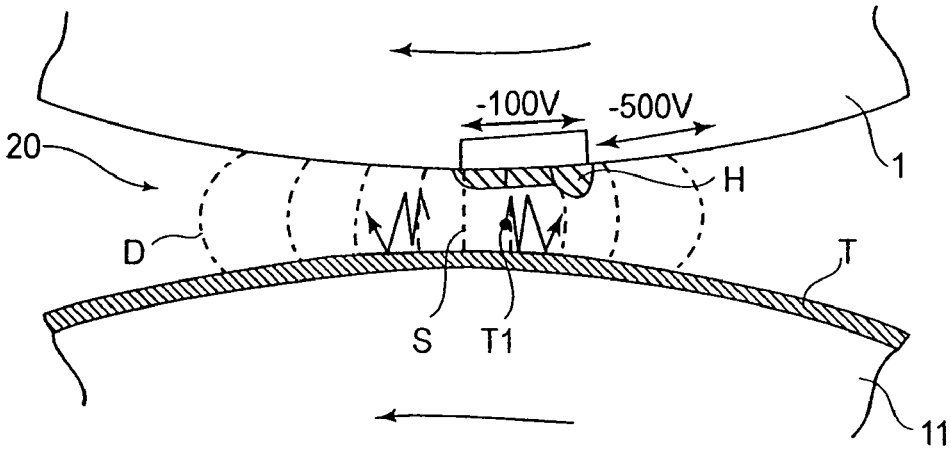
FIG.18 PRIOR ART
FIG. 18 is a description of heaping.

The image forming apparatus 100 and the developing device 10 of this embodiment are similar to those of FIG. 17, and the same reference numerals as in FIG. 17 are assigned to the elements having the corresponding functions in this embodiment, and the detailed description thereof is omitted for simplicity.

In the image forming apparatus 100 of this embodiment, the image bearing member 1 (usually an electrophotographic photosensitive member in the form of a drum) is uniformly charged by the primary charger 2 (charging means) and is then exposed to image information light through the exposure device 3 by which an electrostatic latent image is formed thereon. The electrostatic latent image on the photosensitive drum 1 is developed by developing device 10 (developing means) into a visualized image, namely, a toner image.

The toner image is transferred onto a transfer material Q supplied from a sheet feeding apparatus 7 by a transfer charger 4. The transfer material Q is separated from the photosensitive drum 1 and is fed into a fixing device 6 where the toner image is fixed into a permanent image. The toner T not transferred onto the transfer material by the transfer charger 4 and remaining on the photosensitive drum 1 is removed by a cleaning device 5 (cleaning means) from the photosensitive drum 1, so that photosensitive drum 1 is prepared for the next image forming process operation.

In this embodiment, the image forming apparatus 100 uses a process cartridge type with which the photosensitive drum 1 (image bearing member) and process means actable thereon are unified into a cartridge which is detachably mountable to the main assembly An of the image forming apparatus.

The process means includes charging means for electrically charging the electrophotographic photosensitive member, developing means for supplying the developer to the electrophotographic photosensitive member and cleaning means for cleaning the electrophotographic photosensitive member. Thus, the process cartridge contains the electrophotographic photosensitive member and may contain at least one of the charging means, the developing means and the cleaning means to form a unified cartridge which is detachably mountable to the main assembly of the electrophotographic image forming apparatus. The developing means alone may be formed into a cartridge which is detachably mountable to the main assembly of the electrophotographic image forming apparatus.

In this embodiment, the photosensitive drum 1, the primary charger 2 (charging means), the developing device 4 (developing means), the cleaning device 5 (cleaning means) are unified into a cartridge B which is detachably mountable to the main assembly An of the image forming apparatus by mounting means (unshown).

Figure 2:
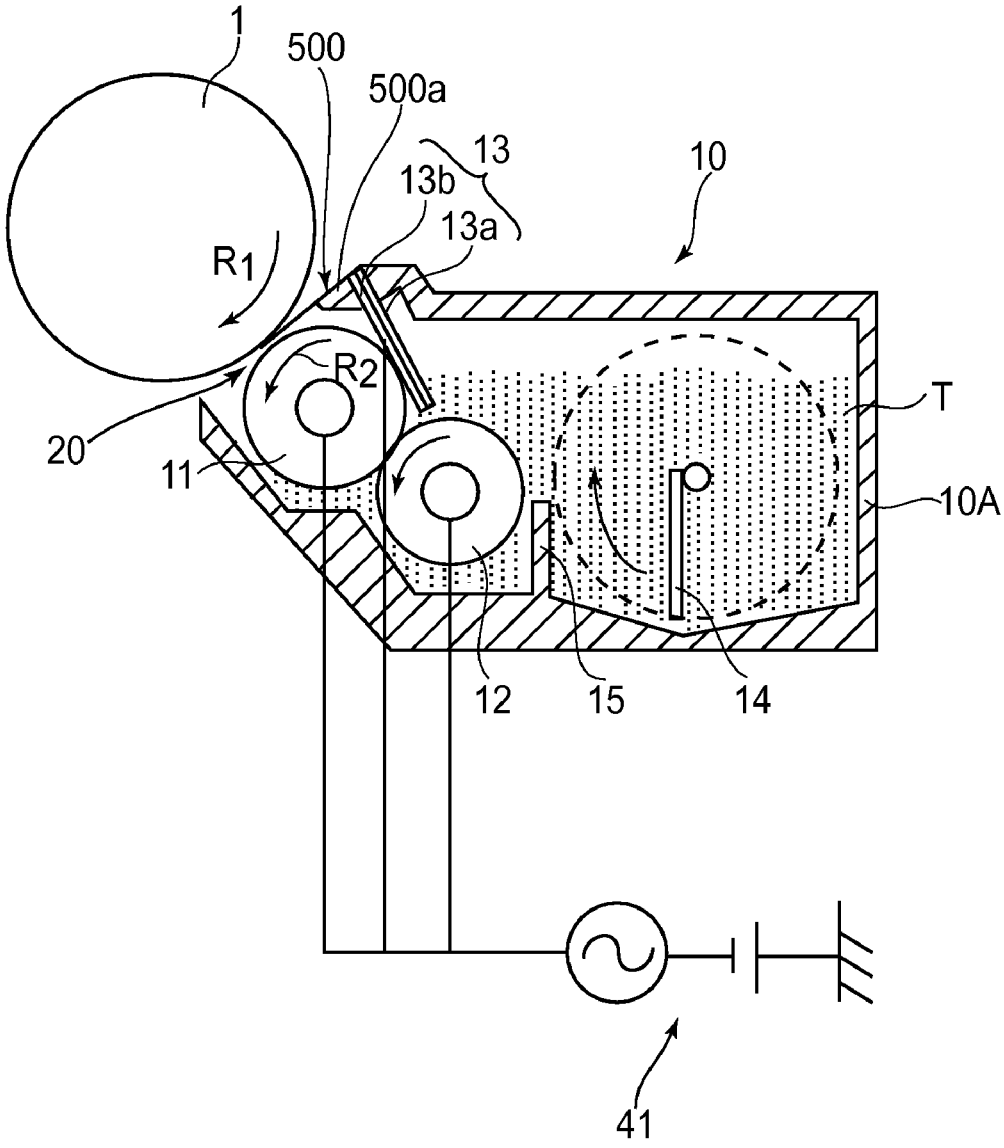
FIG. 2 in addition a schematic illustration of a developing device according to an embodiment of the present invention.

Referring to FIG. 2, the developing device 10 of this embodiment will be described in detail. In this embodiment, the developing device 10 is a non-contact type developing system developing device using non-magnetic one component toner, and has a structure similar to the developing device described in conjunction with FIG. 17, a developing container 10A thereof contains an insulative non-magnetic one component developer (toner) T. In the developing container 10A, there are provided a developing roller 11 (developer carrying member), developer supply and removing roller 12 (developer supply and removing member), a regulating blade 13 (developer amount regulating member), and a toner stirring member 14 in the form of a plate. Furthermore, there is provided a jumping developer blocking member 500.

In this embodiment, one stirring member 14 is employed, but the number thereof is no limited, and two of them may be used. The number of the stirring member 14 may be any if the toner can be fed to the neighborhood of the developing roller 11 from the end of the developing container 10A.

Each of the constituent parts will be described.

In this embodiment, the photosensitive drum 1 comprises an aluminum bare tube having a diameter of 30 mm, the surface of which is coated with photosensitive material such as OPC or the like. The developing roller 11 comprising an aluminum bare tube (sleeve configuration) having a diameter of 16 mm, the surface of which is coated by spray with phenolic resin liquid dispersed with carbon and graphite.

The opposite longitudinal ends of the developing roller 11 are each provided with a SD roller (spacer roller) (unshown) having a diameter larger than that of the developing roller 11 to maintain the distance between the surfaces of the developing roller 11 and the photosensitive drum 1, and the SD rollers are abutted to the surface of the photosensitive drum. With such a structure, the gap between the developing roller 11 and the photosensitive drum 1 (SD gap) is maintained constant, namely 300 μm in this embodiment.

The developer supply and removing roller 12 comprises a metal core metal having a diameter of 5 mm, the outer peripheral surface of which is coated with urethane foam material having a thickness of 4.5 mm.

The regulating blade 13 comprises a phosphor bronze plate 13*a* having a thickness of 100 μm, the surface of which is coated with insulative PA resin material 13*b*, more particularly, polyamide containing rubber (polyamide elastomer) having a thickness of 50 μm in this embodiment.

The operation of the developing device 10 will be described.

In this embodiment, the toner T is non-magnetic one component developer having a negative charging property. The toner stirring member 14 is rotatable in the direction indicated by an arrow in the Figure to feed the toner T from the toner accommodating portion, namely, the developing container 10A, to the developing roller 11.

A developing container partition plate 15 is provided between the toner stirring member 14 and the developer supply and removing roller 12, and the height of the partition plate 15 is determined so as to supply a constant amount of the toner T to the developer supply and removing roller 12 in the neighborhood of the developing roller 11.

The developer supply and removing roller 12 is contacted to the developing roller 11 and is rotated with the counter directional peripheral movement at the nip by which the toner T is supplied onto the developing roller 11 and simultaneously remove, from the developing roller 11, the toner not consumed by the development at the position where the developing roller 11 is opposed to the photosensitive drum 1.

The regulating blade 13 is contacted to the developing roller 11 to regulate the amount of the toner applied on the developing roller 11 so as to formation a thin toner layer, thus regulating the amount of the toner fed into the developing zone 20, and simultaneously it is effective to electrically charging the toner particles. The layer thickness of the toner on the developing roller is thus regulated such that the thickness of the toner layer is smaller than the gap between the photosensitive drum 1 and the developing roller 11, and the toner jumps to the surface of the photosensitive drum 1 from the developing roller 11 in the developing zone.

With such a structure, the toner T is fed on the surface of the developing roller with the desired charge amount and with the desired layer thickness into the developing zone, and reciprocate by the developing bias voltage between the developing roller 11 and the photosensitive drum 1, by which the electrostatic latent image formed on the surface of the photosensitive drum is visualized with the toner. The electric field formed be the developing roller 11 and the photosensitive drum 1 by the developing bias voltage is such an alternating electric field with which the polarity is alternating with respect to the dark portion potential and the light portion potential of the photosensitive member.

Set conditions for the developing device 10 will be described.

The photosensitive drum 1 is rotated in the direction of an arrow R1 in FIG. 2, and the developing roller 11 is rotated in the direction of an arrow R2. The developing roller 11 is supplied from the developing bias voltage source 41 with a developing bias provided by an AC voltage having a peak-to-peak voltage of 2 kV and a frequency of 3 kHz biased with a DC (DC) voltage of −260V. By this, an oscillating (AC) electric field is formed yv between the photosensitive drum 1 and the developing roller 11 in the developing zone. The developing bias is applied to the developer supply and removing roller 12 and to the regulating blade 13. Therefore, the developing roller 11, the developer supply and removing roller 12 and the regulating blade 13 are at the same electric potential.

In order to provide a uniform thin layer on the surface of the developing roller, the regulating blade 13 is pressed to the surface of the developing roller 11 with a line pressure of 30 g/cm in the counter direction with respect to the peripheral movement of the developing roller 11.

Figure 3:
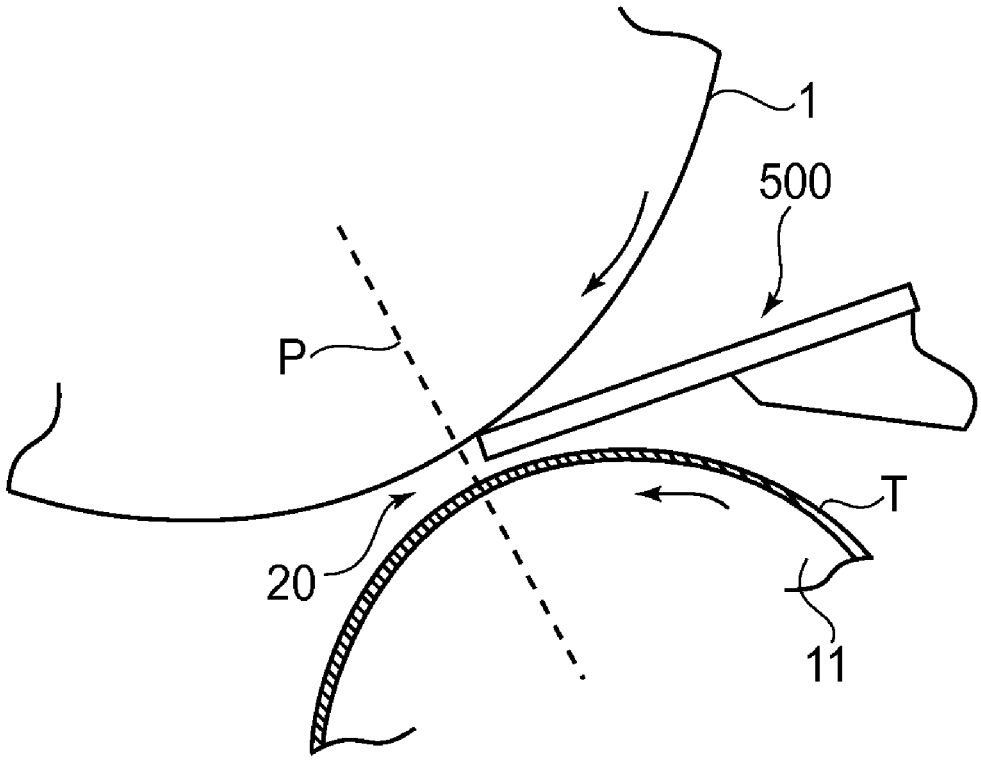
FIG. 3 is an enlarged illustration of a neighborhood of a developing zone in the embodiment of the present invention.

Referring to FIG. 3, the jumping developer blocking member 500 will be described.

FIG. 3 is an enlarged view of the developing zone 20 in the developing device 10 of this embodiment. The jumping developer blocking member (jumping developer control member) 500 is disposed upstream of the developing zone 10 with respect to the developer feeding direction of the developing roller 11, and the free end thereof reaches the neighborhood of a line P connecting the centers of the photosensitive drum 1 and the developing roller 11 in the developing zone 20. Thus, the jumping developer blocking member 500 blocks a part of the region in which the developer jumps from the developing roller 11 to the photosensitive drum 1, thus regulating the jumping region of the developer. This structure is effective to prevent the "heap" or gathering of the developer, as will be described in detail.

Here, referring to FIG. 4, the developing zone 20 will be described.

In the developing device 10, the charged toner particles T are deposited on the surface of the developing roller 11, and the photosensitive drum 1 and the developing roller 11 are at rest. With this state, an AC voltage enough to sufficiently cause the toner particles to jump is applied. By doing so, in a region of the surface of the developing roller adjacent the surface of the photosensitive drum, no or a little amount of the toner T is present as compared with the outside of the region, and in other regions at the opposite ends of the no-toner region, the thickness of the layer of the toner particles is thick. The regions are shown in FIG. 4.

Figure 4:
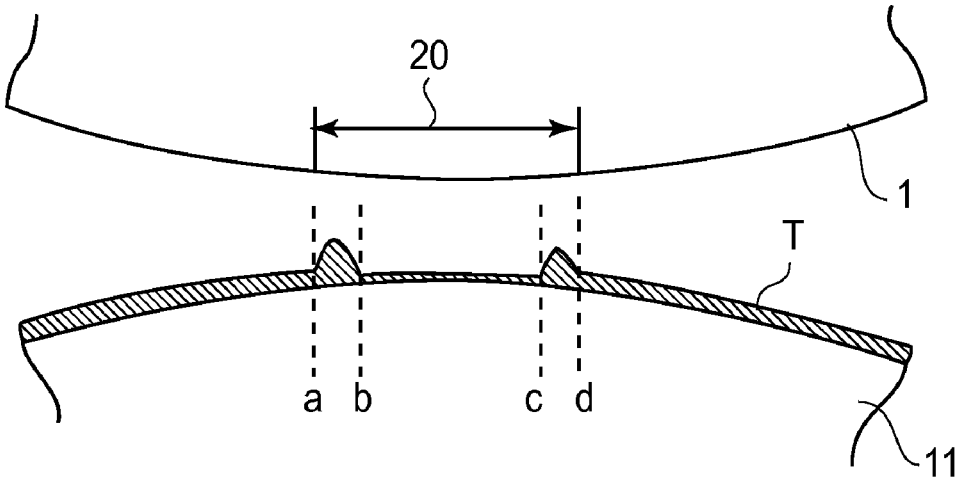
FIG. 4 is an illustration of a developing zone in the embodiment of the present invention.

As shown in FIG. 4, in the regions a-b and c-d, the thickness of the toner layer is large, and in the region b-c, the amount of the toner is small or nothing.

In FIG. 4, the region a-d is the "developing zone" 20. The width of the developing zone 20 is dependent on the diameters of the photosensitive drum 1 and the developing roller 11, the SD gap; the ambient condition such as the temperature, the humidity, the atmospheric pressure or the like; the developing bias voltage; the time duration of the developing bias application; the charge amount of the toner; the deposition amount of the toner on the developing roller.

The experiments of the inventors have shown that width of the developing zone 20 is 4 mm under the conditions of the diameter of the photosensitive drum 1 being 30 mm, the diameter of the developing roller 11 being 16 mm, the SD gap being 300 μm, the average charge amount of the toner on the developing roller being 40 μC/g, the toner deposition amount per unit area on the surface of the developing roller being 0.5 mg/cm2; the ambient conditions are latm, 20° C. and 60% (humidity), the AC voltage having the frequency of 2500 Hz and the peak-to-peak voltage of 2000V being applied between the photosensitive drum 1 and the developing roller 11 for 1 sec.

The position of the jumping developer blocking member 500 will be described.

The image with the "heap", and the assessment method therefor will be described.

Figure 5:
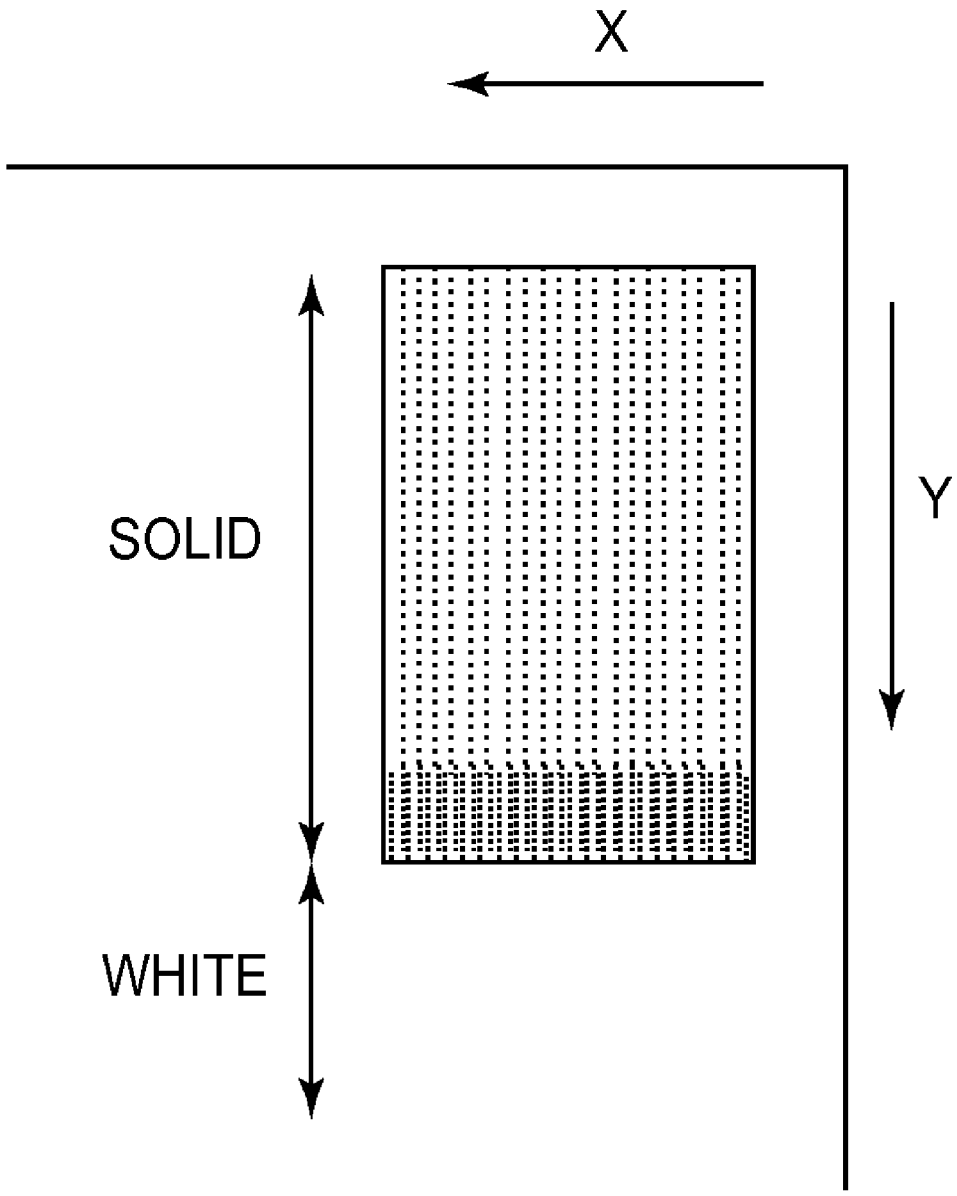
FIG. 5 is an illustration of a sample image involving heap.
Figure 6:
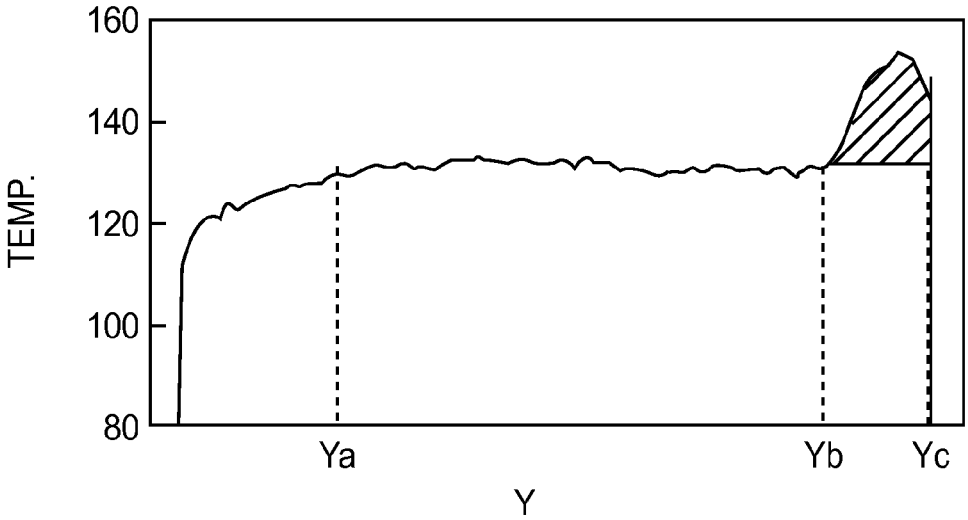
FIG. 6 is an illustration of degitalization of the heaping degree.

The remarkability of the heap increases with the increase of the latent image potential difference on the photosensitive drum. For example, in the case that solid white image (no toner deposition) exists next to the solid color image (maximum density), the heap is remarkable. FIG. 5 shows a part of the image pattern used to investigate the effects of the present invention. The solid image of 30 mm×20 mm (longitudinal dimension×lateral dimension) is followed by a white image. Such an image pattern is read into a PC by an image scanner system, and the image density is converted to numerical data between 0 and 255. FIG. 6 shows a density distribution of the sample image in the Y axis direction.

The measuring method for making numerical data of the heaping will be described.

In FIG. 6, the density is large in the range from Yb to Yc than in the range from Ya to Yb. Thus, the range from Yb to Yc is the heap region. In FIG. 6, the area of the hatching lines is an integration of the density, and the heaping level is defined as the density change per 1 mm. With the result of the measurement of FIG. 6, the size of the region Yb-Yc is 4 (mm), and the integration of the density of the heated area (the area indicated hatching lines) is 160 (dig). Therefore, the heaping level is 160/4=40 (dig/mm).

The experiments and investigations of the inventors have revealed that heaping in the image is not remarkable in visual observation if the heaping level is not more than 20 (dig/mm). From these observations, the image is assessed as being good if the heaping level is not more than 20 (dig/mm).

Figure 7:
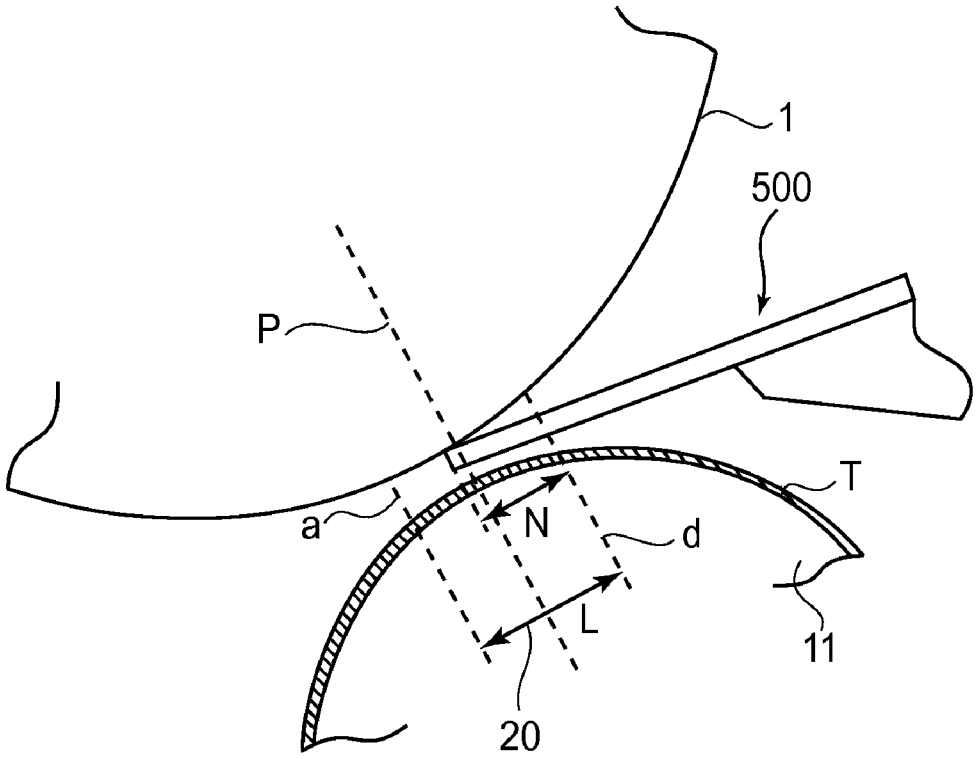
FIG. 7 is a model of the developing zone.

FIG. 7 is an enlarged view of a neighborhood of the developing zone 20 in this embodiment. Th range from the point a to d corresponds to the developing zone 20 described in conjunction with FIG. 4 and has a length L (mm), and the range from the free end of the jumping developer blocking member 500 to the point d is a depth of insertion N (mm) of the jumping developer blocking member 500 into the developing zone.

Figure 8:
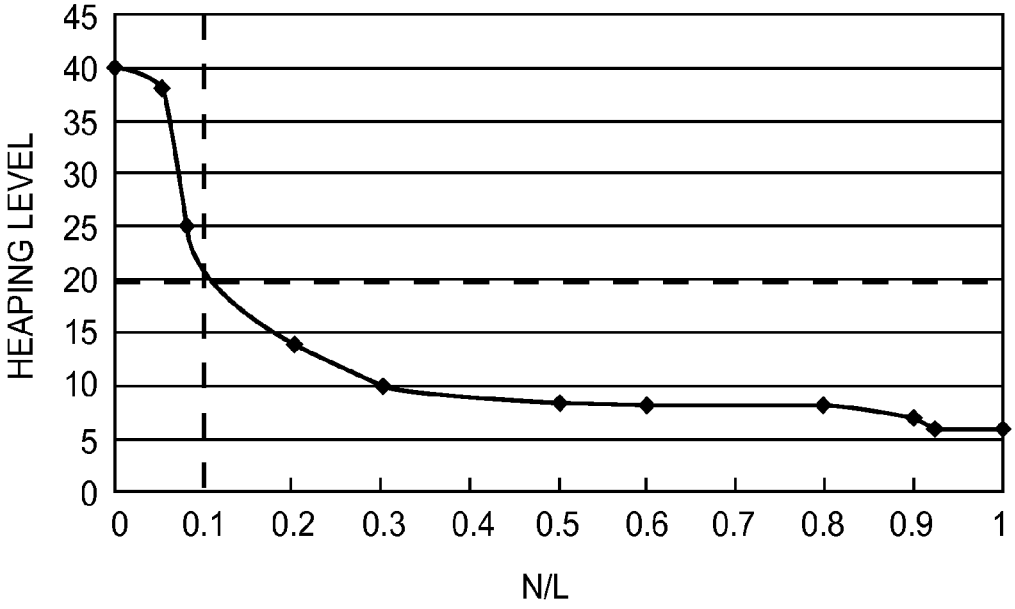
FIG. 8 is a graph of the heaping vs. N/L.

FIG. 8 is a graph of the heaping level vs. N/L. As shown in FIG. 8, the heaping level is less than 20 (dig/mm) when the N/L is not less than 0.1.

Figure 9:
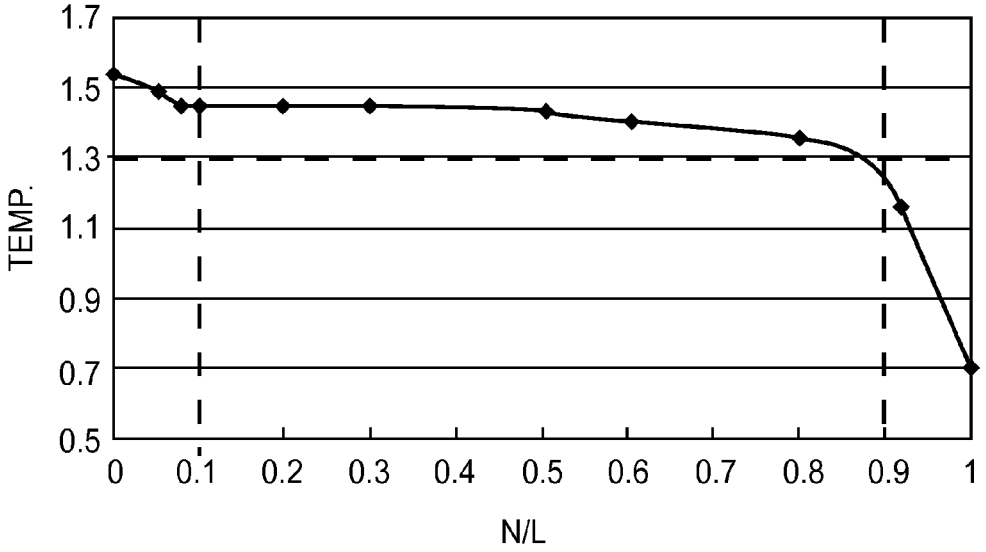
FIG. 9 is a graph of sample image density vs. N/L.

FIG. 9 is a graph of the solid image density of the image vs. N/L. The density was measured using Macbeth Series1200 densitometer. As shown in FIG. 9, the image density is not sufficient when the N/L is not less than 0.9. From the foreign, it is understood that heaping can be suppressed by setting the jumping developer blocking member 500 such that $0.1 \leqq N/L \leqq 0.9$. By doing so, the heaping can be suppressed while maintaining a proper level of the image density.

When the heaping level is not more than 10 (dig/mm), it is not possible to visually recognize the heap. The good images can be produced even under the conditions of the solid density not less than 1.4, the low temperature and the low humidity with which the toner can not easily jump off. Therefore, from FIG. 8 and FIG. 9, the jumping developer blocking member 500 is desirably disposed so as to satisfy $0.3 \leqq N/L \leqq 0.6$. When the jumping developer blocking member 500 is in contact to the developing roller 11, the toner which is on the toner with the regulated layer thickness is disturbed with the result of disturbance of the image. Positioning the jumping developer blocking member 500 so as not to contact the developing roller 11 or the photosensitive drum 1, is very difficulty since the gap between the photosensitive drum 1 and the developing roller 11 is very small. Therefore, it is desirable to position the jumping developer blocking member 500 so as not to contact the developing roller 11 but to contact the photosensitive drum 1. By doing so, the heaping can be suppressed without disturbing the image.

When the jumping developer blocking member 500 made of insulative PET (polyethylene terephthalate) sheet is contacted to the photosensitive drum 1, the electrostatic latent image thereon is not disturbed. The PET sheet preferably has a thickness of 100 μm, and the contact pressure to the photosensitive drum 1 is preferably not more than 5 gf.

In this embodiment, the jumping developer blocking member 500 is mounted on the developing container 10A through the insulative PA resin material 13*b* of the regulating blade 13 at the mounting portion 500*a*, as shown in FIG. 2.

Figure 10:
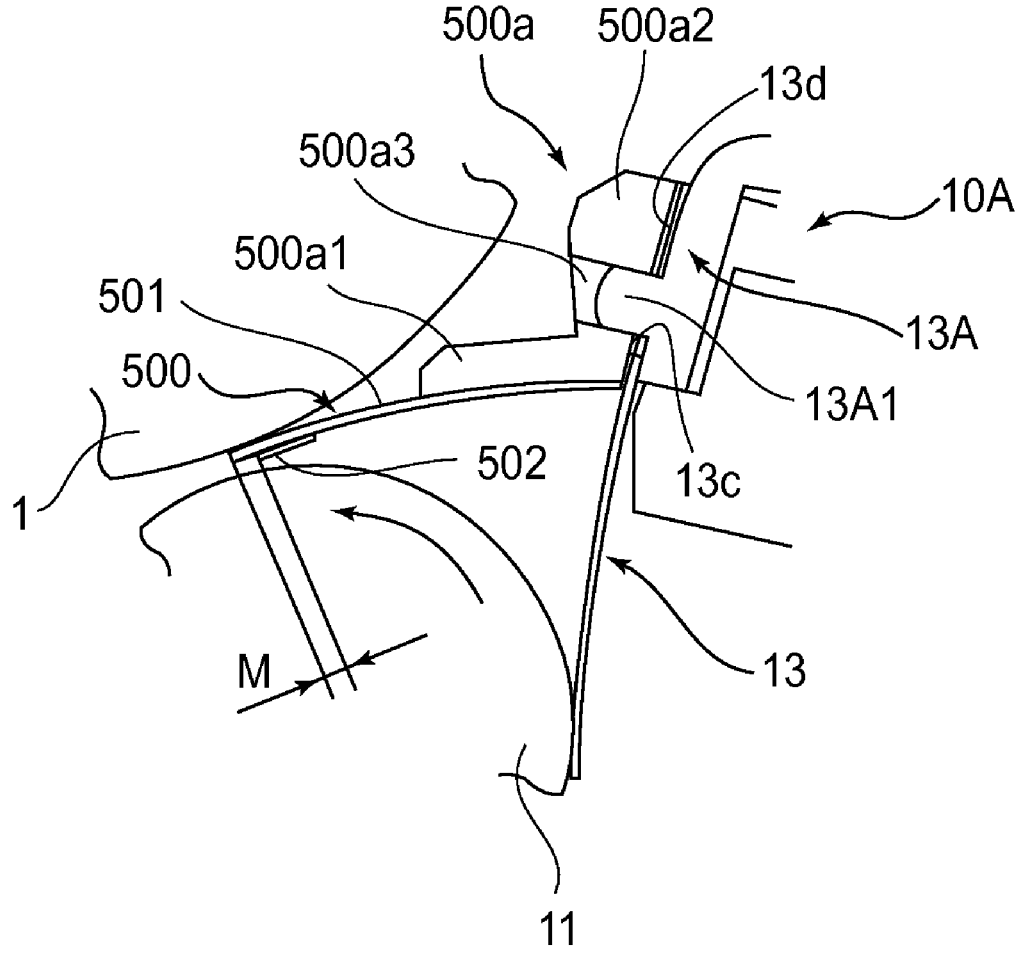
FIG. 10 is an illustration of a mounting structure of a jumping developer blocking member to the developing container according to the embodiment of the present invention.
Figure 11:
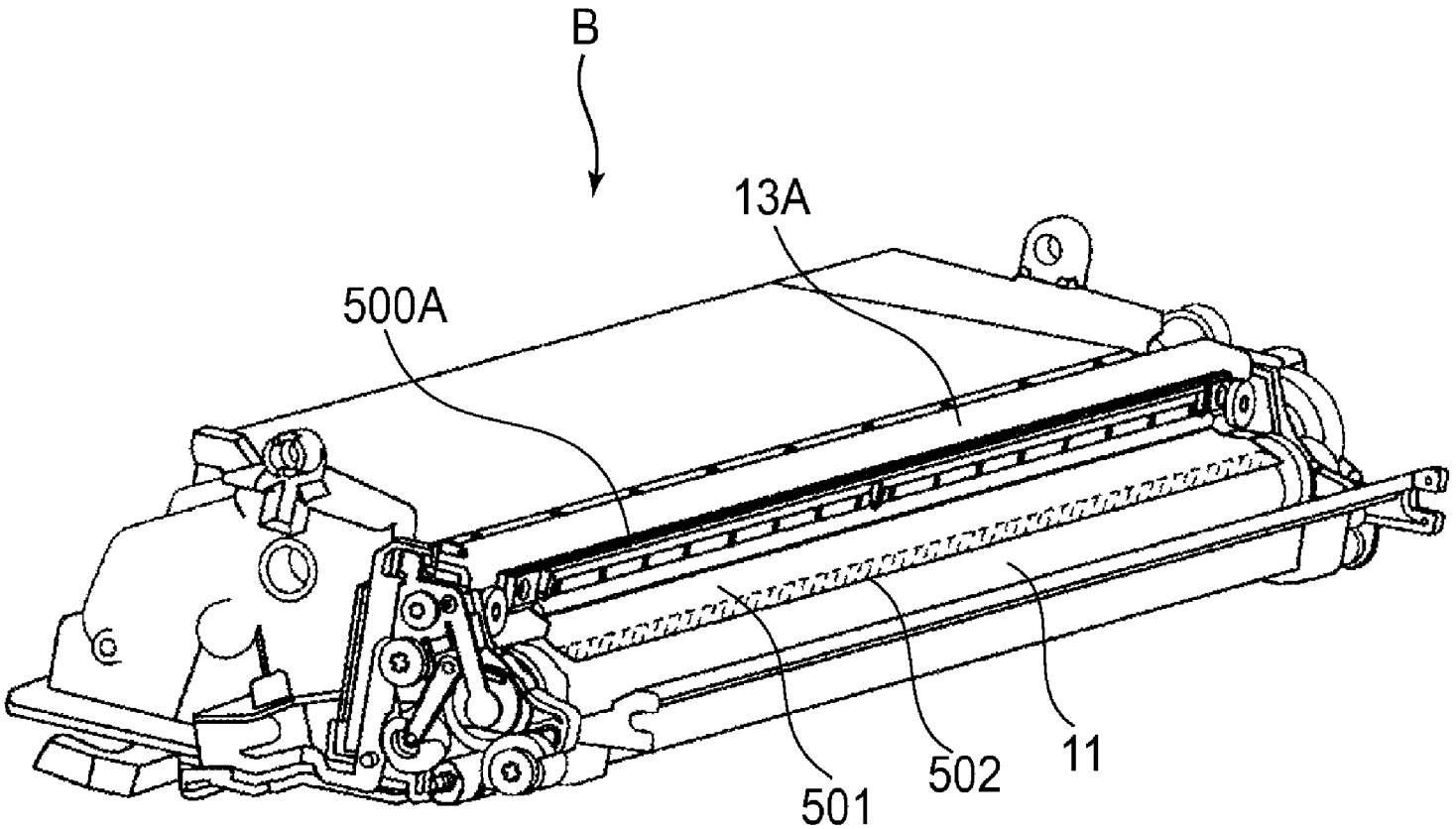
FIG. 11 is a perspective view of a developing device in a process cartridge, wherein the jumping developer blocking member is mounted in place.
Figure 16:
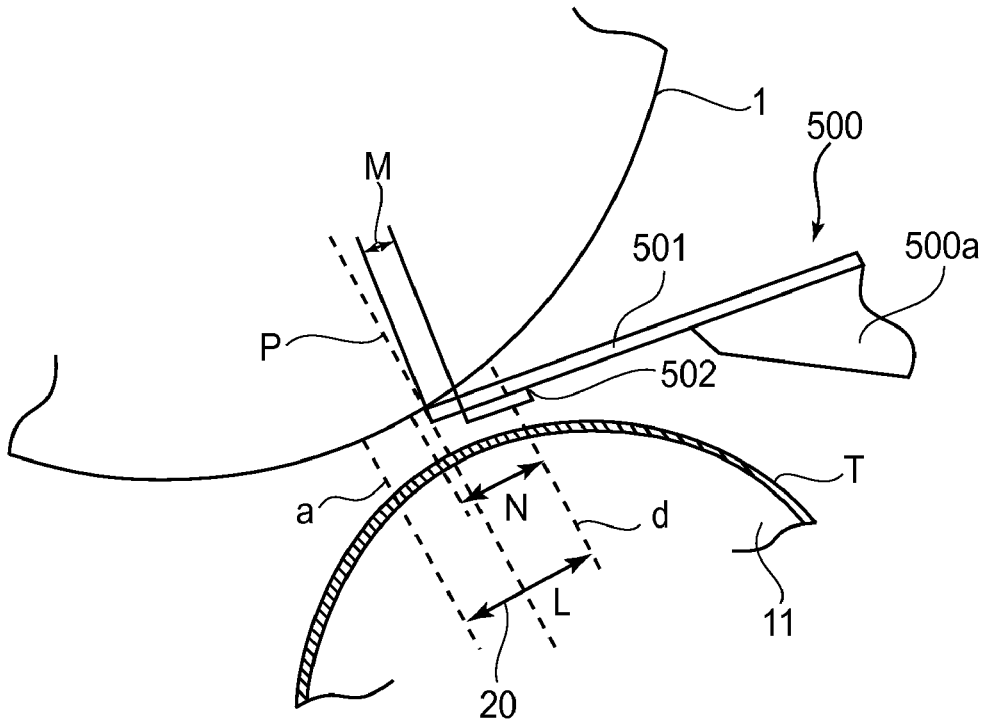
FIG. 16 is an enlargement illustration of a jumping developer blocking member in a neighborhood of a developing zone according to a further embodiment of the present invention.

FIG. 10 and FIG. 11 shows a specific example of the mounting of the jumping developer blocking member 500 on the developing container 10A. FIG. 10 illustrates a mounting structure in which the jumping developer blocking member 500 is mounted on the developing container 10A, and FIG. 11 illustrates the developing device 10 of a process cartridge B on which the jumping developer blocking member 500 is mounted. In FIG. 10, the structure of the jumping developer blocking member 500 is as shown in FIG. 16, which will be described in detail (Embodiment 2). The structure is not limited to the shown example.

In the structure shown in FIG. 10 and FIG. 11, the regulating blade 13 is mounted on the developing container 10A by the mounting portion 13A. More particularly, the regulating blade 13 has a positioning hole 13*c* which is engaged with a positioning boss 13A1 provided at the regulating blade mounting portion 13A.

On the other hand, the jumping developer blocking member 500 is fixed through the regulating blade 13 on the regulating blade mounting portion 13A by a supporting member 500*a* constituting the mounting portion.

In this embodiment, the supporting member 500*a* is generally L shaped comprising a horizontal member 500*a*1 and a perpendicular member 500*a*2, and the jumping developer blocking member 500 is mounted on the horizontal member 500*a*1. The perpendicular member 500*a*2 has a positioning hole 500*a*3 which is engaged with a positioning boss 13A1 provided in the regulating blade mounting portion 13A.

Therefore, the perpendicular member 500*a*2 of the supporting member 500*a* contacts such a side of the regulating blade 13 as contacts the developing roller 11, namely, contacts the insulative PA resin material 13*b* (FIG. 2) of the regulating blade 13. The perpendicular member 500*a*2 may be secured on the regulating blade 13 by a double coated tape or an adhesive material 13*d*, or may be secured by a screw.

The positioning of the supporting member 500*a* relative to the regulating blade 13 is accomplished by the boss 13A1 of the regulating blade mounting portion 13A. In an alternative mounting method, however, the supporting member 500*a* is mounted on the regulating blade 13 with a further precision using a special assembling tool with which the supporting member 500*a* is mounted to the regulating blade 13 with fine adjustment. In order to permit the adjustment, the hole 500*a*3 of the supporting member 500*a* is larger than the positioning boss 13A1 formed in the regulating blade mounting portion 13A.

By doing so, the supporting member 500*a* and the regulating blade 13 can be positioned more precisely.

The structure of the jumping developer blocking member 500 will be further described.

Figure 12:
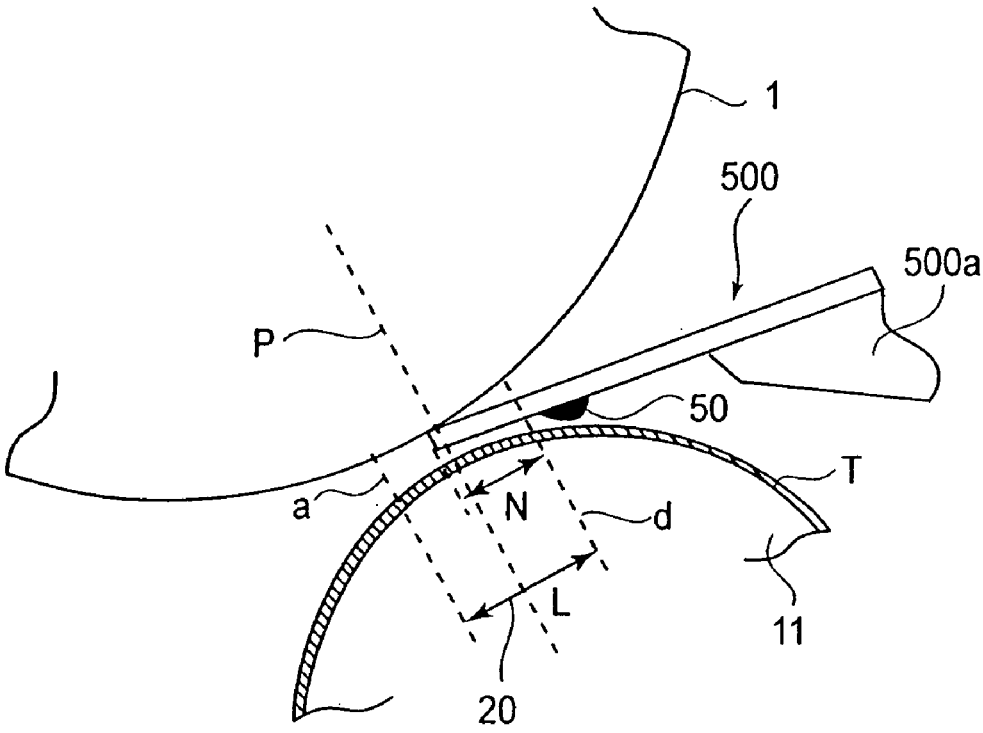
FIG.12 PRIOR ART
FIG. 12 is an enlarged illustration of a jumping developer blocking member in a neighborhood of the developing zone.

As shown in FIG. 12, when the jumping developer blocking member 500 is made of insulative PET sheet, a toner stagnation 50 occurs upstream of the developing zone 20. The toner stagnation 50 is an accumulation of scattered toner particles produced during the developing operation. The toner stagnation 50 may leave the jumping developer blocking member 500 during a developing operation and may be transferred onto the photosensitive drum 1 with the result of image defect. This is called mass drop.

Figure 13:
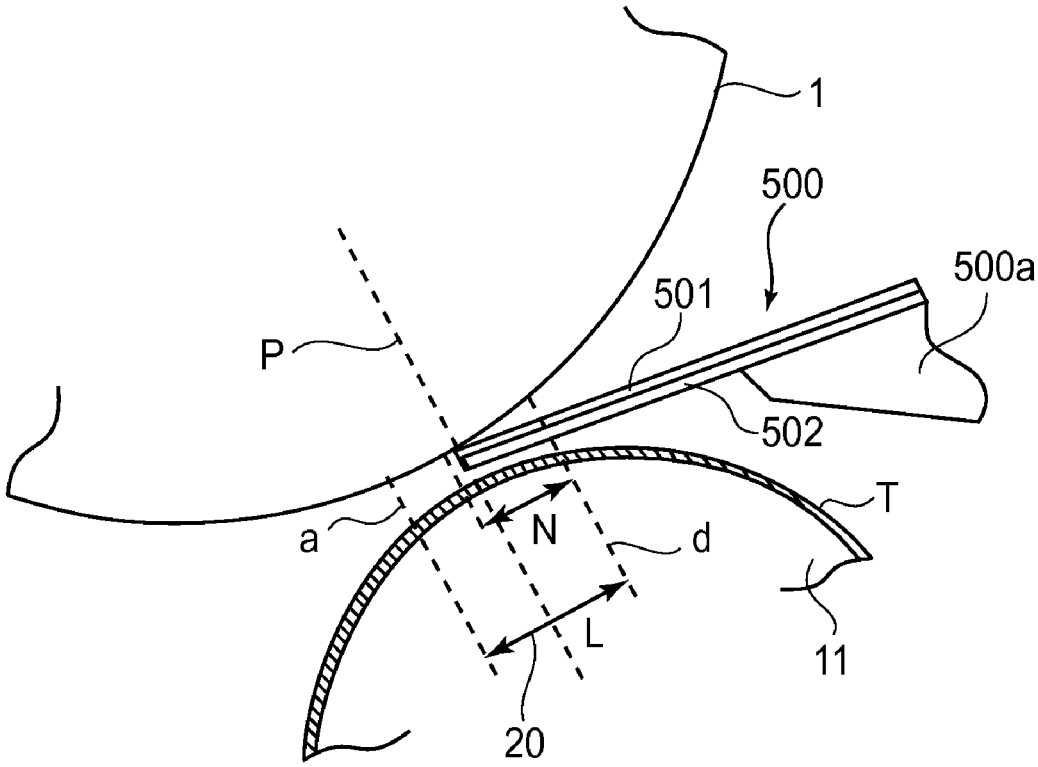
FIG. 13 is an enlarged illustration of a jumping developer blocking member in a neighborhood of the developing zone according to an embodiment of the present invention.

In order to avoid such a problem, this embodiment employs, as shown in FIG. 13, the jumping developer blocking member 500 is constituted by an insulative sheet 501 and an electroconductive sheet 502.

The insulative sheet 501, in this embodiment, is made of PET (polyethylene terephthalate) having a thickness of not less than 25 μm and not more than 50 μm, and the electroconductive sheet 502 is made of Al (aluminum) having a thickness of not less than 5 μm and not more than 30 μm.

The heap suppression effect of the jumping developer blocking member 500 is based on blocking the electric field in the developing zone 20, and more particularly, the insulative sheet 501 functions to block the electric field in the developing zone 20. However, with such a structure alone, the mass drop cannot be prevented. Toner stagnation 50 which may drop as a mass is electrostatically deposited on the upstream side of the developing zone 20.

Therefore, in order to prevent the production of the toner stagnation 50, the sheet surface opposed to the developing roller 11 is made electroconductive.

In addition, according to this embodiment, no bias voltage is applied directly to the electroconductive sheet 502, but the electroconductive sheet 502 is electrically float. However, by making the sheet 502 electroconductive, the AC bias applied to the developing roller 11, in effect, applies to (induces in) the electroconductive sheet 502, an AC voltage (having a peak-to-peak voltage of 1 kV and a frequency of 3 kHz) which is lower than the developing bias voltage (having a peak-to-peak voltage of 2 kV and a frequency of 3 kHz), through the gap of 200 μm.

As a result, an oscillating electric field is generated in the electroconductive sheet 502, and therefore, the jumping developer blocking member 500 vibrates. By the vibration, the deposition of the toner can be prevented.

If the electroconductive sheet 502 is not electrically floated but a voltage is directly applied, a current leakage may be produced to the developing roller 11 or to the photosensitive drum 1, with the result of image disturbance. If the voltage applied directly to the electroconductive sheet 502 is the same as the voltage applied to the developing roller, the jumping developer blocking member 500 does not vibrate, and therefore, the deposition of the toner cannot be prevented.

Figure 14:
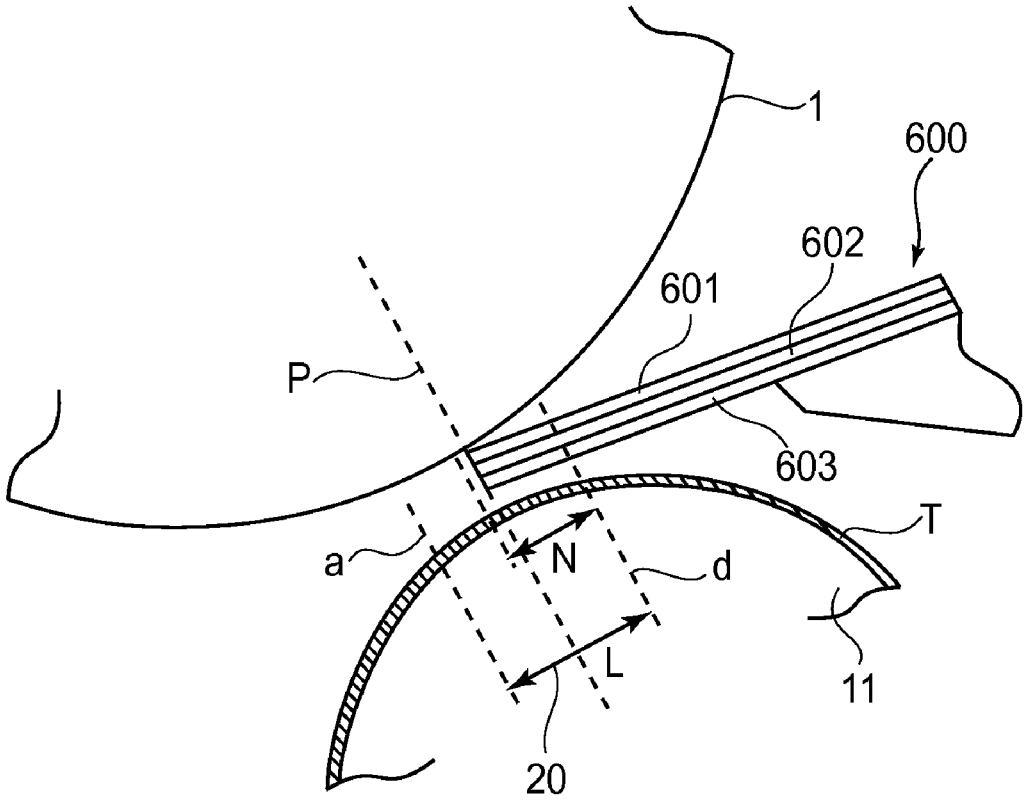
FIG. 14 is an enlarged illustration of a jumping developer blocking member in a neighborhood of the developing zone.

FIG. 14 illustrates a jumping developer blocking member 600 of a comparison example. The jumping developer blocking member 600 of the comparison example comprises an electroconductive sheet 602 sandwiched by an insulative sheet 601 and an insulative sheet 603. With this structure, the electroconductive sheet 602 is not opposed to the developing roller 11.

In this citation, the AC bias applied to the electroconductive sheet 602 is small due to the electrostatic capacity of the insulative sheet 603, so that deposition of the toner is not sufficiently prevented. In addition, the thickness of the jumping developer blocking member 600 is large to retard the vibration. In such a case, the toner stagnation may be produced.

Therefore, it is preferable that insulative sheet 501 is provided at the photosensitive drum 1 side of the jumping developer blocking member 500, and the electroconductive sheet 502 is provided on the developing roller 11 side.

In this embodiment, the volume resistivity of the insulative sheet 501 is preferably not less than $10^{10}$ Ωcm from the standpoint of prevention of heaping. If is less than $10^{10}$ Ωcm, the electric field blocking effect is not enough, and therefore, the heap preventing effect is not enough. As regards the upper limit of the volume resistivity, the higher the better, but since it is an elastomer, the upper limit is practically $10^{13}$ Ωcm.

On the other hand, the volume resistivity of the electroconductive sheet 502 is preferably less than $10^5$ Ωcm. If is larger than $10^5$ Ωcm, an oscillating electric field is not produced in the electroconductive sheet 502, and therefore, the toner deposition cannot be prevented. Normally, the lower limit is approx. 10 Ωcm when the use is made with metal material.

As described hereinbefore, in this embodiment, the insulative sheet 501 is made of PET and has a thickness of 25-50 μm, and the electroconductive sheet 502 is made of Al and has a thickness of 5-30 μm. When the insulative sheet 501 is made of PET and has a thickness of less than 25 μm, the sheet resistance decreases due to the tunnel effect. For this reason, the electric field shielding or blocking is not sufficient with the result of insufficient heap preventing effect. If the thickness of the insulative sheet 501 made of PET is larger than 50 μm, the rigidity of the sheet is so strong that vibration effect is deteriorated, and the effect of prevention of the toner deposition is not sufficient. The electroconductive sheet 502 is made of Al and has a thickness of 5-30 μm. If it is thicker than 30 μm, the vibration effect of the sheet is not sufficient.

Other usable materials for the insulative sheet include PVDF (polyvinylidene fluoride), PA (polyamide), PI (polyimide) or the like, and with these material, the equivalent effects are provided.

Other usable materials for the electroconductive sheets include other metals, carbon or the like having a low resistance. The surface roughness is preferably not less than 0.1 μm and not more than 10 μm in ten point average roughness Rz. If the surface roughness exceeds 10 μm, the toner stagnation 50 is great, and if it is smaller than 0.1 μm, the sheet is difficult to produce.

Embodiment 2

Figure 15:
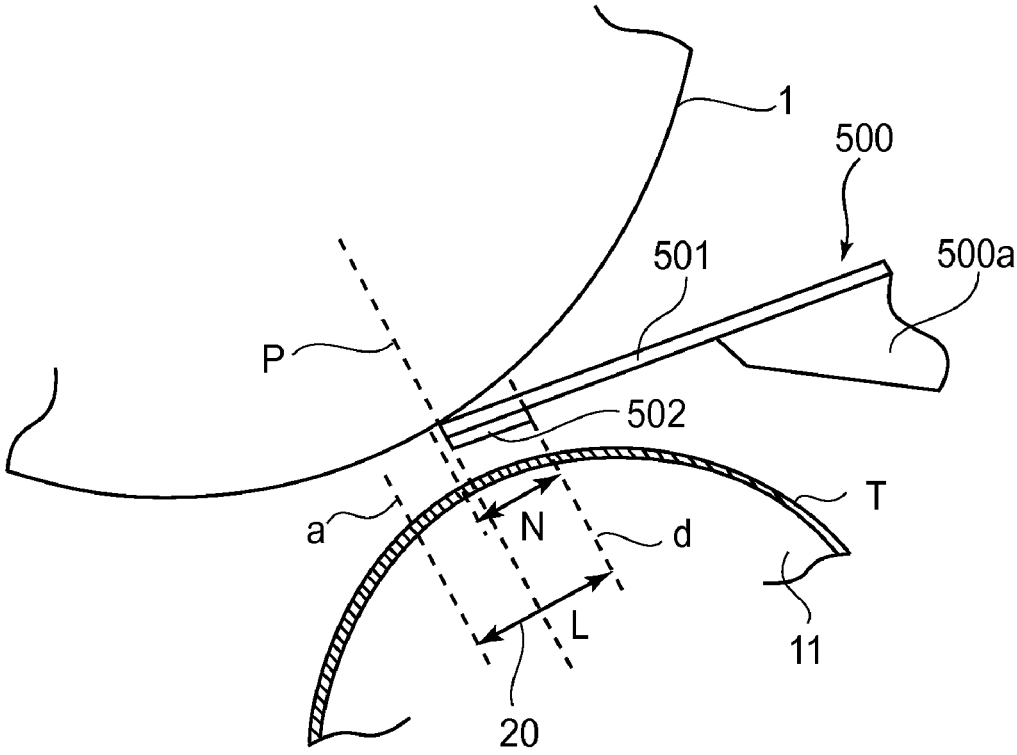
FIG. 15 is an enlargement illustration of a jumping developer blocking member in a neighborhood of a developing zone according to another embodiment of the present invention.

FIG. 15 is an enlarged detailed view of a jumping developer blocking member in a developing zone according to another embodiment of the present invention.

In this embodiment, as shown in FIG. 15, similarly to Embodiment 1, the jumping developer blocking member 500 comprises an insulative sheet 501 (insulative member) and an electroconductive sheet 502 (electroconductive member). In this embodiment, the insulative sheet 501 is made of PET and has a thickness of 38 μm, and the electroconductive sheet 502 is made of Al and has a thickness of 15 μm.

The mechanism of the heap suppressing effect of the jumping developer blocking member 500 is based on blocking or shielding of the electric field in the developing zone 20, and in this embodiment, the insulative sheet 501 in the developing zone 20 provide the electric field shielding effect.

However, if the jumping developer blocking member 500 is constituted by the insulative sheet alone, the mass drop may occur. Toner stagnation 50 which may drop as a mass is electrostatically deposited on the upstream side of the developing zone 20.

To avoid this, it is preferable that sheet surface opposed to the developing roller 11 is made electroconductive since then the production of the toner stagnation 50 can be prevented. The electroconductive sheet 502 is not directly supplied with the voltage, and it is electrically floated. In addition, in this embodiment, as shown in this Figure, the area of the electroconductive sheet 702 is small, and it exists only at the free end portion of the jumping developer blocking member 700. With such a structure, the AC developing bias voltage (having a peak-to-peak voltage of 2 kV and a frequency of 3 kHz) applied to the developing roller 11 induces, through the gap 200 μm, in the electroconductive sheet 502, an AC voltage (having a peak-to-peak voltage of 0.5 kV and a frequency of 3 kHz) which is smaller than in the case of Embodiment 1 (peak-to-peak voltage of 1 kV and a frequency of 3 kHz).

As a result, an oscillating electric field which is larger than in Embodiment 1 is produced in the electroconductive sheet 502, so that jumping developer blocking member 500 vibrates in a greater magnitude. Such vibration is effective to provide a larger design margin for the toner deposition prevention.

The volume resistivity of the insulative sheet 501, similarly to the case of Embodiment 1, is preferably not less than $10^{10}$ Ωcm from the standpoint of heap prevention. If is less than $10^{10}$ Ωcm, the electric field blocking effect is not enough, and therefore, the heap preventing effect is not enough. The volume resistivity of the electroconductive sheet 502 is preferably less than $10^5$ Ωcm. If it is not less than $10^5$ Ωcm, no oscillating electric field is produced in the electroconductive sheet 702, and therefore, the toner deposition is not possible.

Other materials for the insulative sheet 501 include PVDF, PA, PI or the like, and equivalent effects are provided using these materials. Other materials of the electroconductive sheet 502 include metals, material said aluminum having a low resistance. The surface roughness is preferably not less than 0.1 μm and not more than 10 μm in ten point average roughness Rz.

In this embodiment, the electroconductive sheet 502 is made of Al and has a thickness of 15 μm. In another method of providing the insulative sheet 501 contacted to the photosensitive drum 1 and having the electroconductive part at a side opposed to the developing roller, the Al is evaporated on the PET having a thickness of 25-50 μm or the Al sheet of 15 μm thick, and then the PET is bonded on the insulative sheet 501 by double coated tape or the like.

In such a case, the double coated tape may slightly projects at the connecting portion between the insulative sheet 501 and the PET having the electroconductive surface, and then, the dust and/or foreign matter may be deposited on the projected double coated tape. If this occurs, the toner layer on the developing roller 11 may be disturbed thereby, or the toner image on the photosensitive drum 1 may be disturbed with the result of image defect.

As shown in FIG. 16, to avoid this, the electroconductive sheet 502 is disposed slightly away from the photosensitive drum side end of the insulative sheet 501 so that connecting portion between the insulative sheet 501 and the PET having the electroconductive surface is spaced from the developing zone by a gap M, by which even if the dust and/or foreign matter are deposited on the double coated tape, the disturbance to the toner in the disposition can be prevented. In this case, the gap M is approx. 0.5-1.5 mm.

As a method of inserting the free end of the insulative sheet 501 into the developing zone with high precision, it is possible to stick the insulative sheet 501 on the supporting member 500*a*, and thereafter, the free end of the insulative sheet 501 is cut by a special tool. By doing so, the positional deviation of the free end of the insulative sheet 501 attributable to the part tolerances of the insulative sheet 501 and the supporting member 500*a* and the positional deviation in the sticking of the insulative sheet 501 on the supporting member 500*a* can be corrected, by which the degree of insertion of the insulative sheet 501 into the developing zone is stabilized, and therefore, the heap preventing effect can be stabilized.

In such a case, however, if the insulative sheet 501 and the PET having the electroconductive surface are connection with each other by a double coated tape is cut, the double coated tape is exposed at the cut portion. Then, the double coated tape is exposed at the free end of the insulative sheet 501 close to the photosensitive drum 1, and if the dust and/or the foreign matter are deposited on the double coated tape there, the toner in the developing zone is disturbed.

In an attempt to avoid this, if the gap M between the free end of the insulative sheet 501 and the PET having the electroconductive surface is made larger so as not to cut the double coated tape connecting portion, the PET having the electroconductive surface is too remote from the free end of the insulative sheet 501. Then, the distance between the electroconductive surface and the developing roller 11 is too large to provide the electroconductive sheet vibration effect by the developing bias.

In order to reduce the variation in the amount of insertion of the insulative sheet 501 into the developing zone by cutting the free end of the insulative sheet 501, an electroconductive portion forming method of a printing type is preferable. More particularly, ink containing metal, carbon or the like is directly printed on the insulative sheet 501. By doing so, the electroconductive sheet vibration effect by the developing bias can be provided, and even when the free end side of the insulative sheet 501 having the printed electroconductive layer is cut, the adhesive layer is not exposed, and therefore, the toner is not disturbed in the developing zone by the dust and/or foreign matter. By the formation of the electroconductive portion by printing, the thickness of the jumping developer blocking member 500 can be easily made small.

As described hereinbefore, the thickness of the printed electroconductive portion on the insulative sheet 501 is preferably not less than 5 μm and not more than 30 μm.

In the foregoing description, the developing device 10 is in a process cartridge B which is a unit containing the photosensitive drum 1, the charging means 2, the cleaning device 5 and so on and which is detachably mountable to the mounting portion of the main assembly An of the apparatus as a unit. The developing device 10 of the present invention may be provided in the main assembly An of the image forming apparatus. The developing device 10 may be in a developing cartridge which is detachably mountable, as a unit, to the main assembly An of the image forming apparatus.

While the invention has been described with reference to the structures disclosed herein, it is not confined to the details set forth, and this application is intended to cover such modification or changes as may come within the purposes of the improvements or the scope of the following claims.

This application claims Priority from Japanese Patent Application No. 364985/2004 filed Dec. 16, 2004 which is hereby incorporated by reference.

What is claimed is:

1. A developing device comprising:

a developer carrying member for carrying a developer to develop an electrostatic latent image formed on an image bearing member with the developer, wherein an oscillating electric field is formed between said developer carrying member and the image bearing member; and a jumping developer blocking member, provided between the image bearing member and said developer carrying member, for blocking a part of a region in which the developer jumps from said developer carrying member to the image bearing member, wherein said jumping developer blocking member includes an insulative portion, and an electrically insulated electroconductive portion disposed opposed to said developer carrying member and exposed at such a surface of said jumping developer blocking member as is adjacent to said developer carrying member.

2. A device according to claim 1, wherein said jumping developer blocking member is disposed upstream of a developing zone with respect to a developer feeding direction of said developer carrying member, and wherein a length L (mm) of the developing zone, and a length N (mm) from an upstream starting position of the developing zone to a free end of said jumping developer blocking member satisfy:

$$0.1 \leqq N/L \leqq 0.9.$$

3. A device according to claim 1, wherein said jumping developer blocking member is out of contact to the developer carried on said developer carrying member in the developing zone.

4. A device according to claim 1, wherein said jumping developer blocking member is in the form of a sheet having an elastic property, and is press-contacted to the surface of the image bearing member.

5. A device according to claim 1, wherein said insulative portion has a volume resistivity not less than $10^{10}$ Ωcm, and said electroconductive portion has a volume resistivity of less than $10^{5}$ Ωcm.

6. A device according to claim 1, wherein said insulative portion has a thickness of not less than 25 μm and not more than 50 μm.

7. A device according to claim 1 or 6, wherein said electroconductive portion has a thickness of not less than 5 μm and not more than 30 μm.

8. A device according to claim 1, wherein said electroconductive portion has a surface having a ten point average roughness of not less than 0.1 μm and not more than 10 μm.

9. A device according to claim 1, wherein said electroconductive portion is spaced away from a free end of said insulative portion.

10. A device according to claim 1, wherein said electroconductive portion is provided by printing electroconductive ink on said insulative portion.

11. A device according to claim 1, wherein the developer is a non-magnetic one component developer.

12. A device according to claim 1, wherein said developing device is provided in a cartridge detachably mountable to a main assembly of the image forming apparatus.

* * * * *

UNITED STATES PATENT AND TRADEMARK OFFICE

CERTIFICATE OF CORRECTION

PATENT NO. : 7,286,791 B2
APPLICATION NO. : 11/275144
DATED : October 23, 2007
INVENTOR(S) : Yasuyuki Ishii et al.

It is certified that error appears in the above-identified patent and that said Letters Patent is hereby corrected as shown below:

COLUMN 1:
Line 26, “form” should read --from--.

COLUMN 2:
Line 64, “outsides” should read --outside--.

COLUMN 3:
Line 27, “example)” should read --example).¶--;
Line 48, “in addition” should read --is--; and
Line 55, “degitalization” should read --determination-- and “degree.” should read -- degree as numerical data.--.

COLUMN 5:
Line 27, “no” should read --not--.

COLUMN 6:
Line 8, “remove,” should read --removed,--;
Line 14, “formation” should read --form--;
Line 26, “reciprocate” should read --reciprocated--;
Line 30, “be” should read --by--; and
Line 44, “yv” should be deleted.

COLUMN 7:
Line 59, “large” should read --larger--; and
Line 65, “heated” should read --heaped--.

COLUMN 8:
Line 8, “Th” should read --The--;
Line 22, “foreign” should read --foregoing--; and
Line 57, “shows” should read --show--.

COLUMN 9:
Line 53, “is” should be deleted.

COLUMN 10:
Line 6, “float” should read --floated--;
Line 41, “501 is” should read --501 be--;
Line 44, “502 is” should read --502 be--.

UNITED STATES PATENT AND TRADEMARK OFFICE

CERTIFICATE OF CORRECTION

PATENT NO. : 7,286,791 B2
APPLICATION NO. : 11/275144
DATED : October 23, 2007
INVENTOR(S) : Yasuyuki Ishii et al.

It is certified that error appears in the above-identified patent and that said Letters Patent is hereby corrected as shown below:

COLUMN 11:

Line 10, "material," should read --materials,--;
Line 35, "provide" should read --provides--; and
Line 43, "is" should read --be--.

COLUMN 12:

Line 24, "projects" should read --project--;
Line 54, "are connection" should read --connected--.

COLUMN 13:

Line 36, "modification" should read --modifications--.

Signed and Sealed this

First Day of July, 2008

JON W. DUDAS
*Director of the United States Patent and Trademark Office*